United States Patent [19]

Boudreau

[11] 3,930,272

[45] Jan. 6, 1976

[54] CRIB LEG LOCK

[75] Inventor: Robert J. Boudreau, Bedford, Pa.

[73] Assignee: Hedstrom Co., Bedford, Pa.

[22] Filed: Sept. 10, 1974

[21] Appl. No.: 501,533

[52] U.S. Cl. ..... 5/11; 5/100; 248/423; 403/107

[51] Int. Cl.[2] ..... A47D 7/01

[58] Field of Search ..... 5/11, 99 B, 100; 248/188.2, 188.5, 157, 407, 408, 409, 423; 403/107, 108

[56] References Cited

UNITED STATES PATENTS

| | | | |
|---|---|---|---|
| 933,921 | 9/1909 | Patterson | 5/11 X |
| 1,549,144 | 8/1925 | Messegee | 248/188.2 |
| 1,609,246 | 11/1926 | Hamburger | 248/407 X |
| 1,667,080 | 4/1928 | Ramsey | 5/11 |
| 1,834,468 | 12/1931 | Mayette | 5/99 B X |
| 2,545,289 | 3/1951 | Lang | 5/11 |
| 2,560,109 | 7/1951 | Hines | 248/407 X |
| 2,574,559 | 11/1951 | Graf et al. | 5/11 |
| 2,711,301 | 6/1955 | Jaspersen | 403/107 X |
| 2,734,200 | 2/1956 | Kedrowski | 5/11 |
| 3,670,344 | 6/1972 | Boudreau | 5/11 |

*Primary Examiner*—Roy D. Frazier
*Assistant Examiner*—Thomas J. Holko
*Attorney, Agent, or Firm*—Cesari and McKenna

[57] ABSTRACT

A lock for a height-adjustable crib or playpen requires two distinct manual operations in order to release the lock on each crib leg. Each lock includes a rigid metal bracket which engages around the extensible part of the leg and is pivotally connected to a crib corner post. The bracket has a nose which projects into one of a series of openings in the extensible part of the leg then the bracket is swung against the leg part to prevent movement of the leg part relative to the post. The upper edge of the bracket is slotted to receive a latch pivotally connected to the corner post just above the bracket. The latch drops into the slot when the nose is engaged in one of the openings so that the bracket cannot be moved.

3 Claims, 3 Drawing Figures

CRIB LEG LOCK

BACKGROUND OF THE INVENTION

This invention relates to juvenile furniture hardware. It relates more particularly to an improved leg lock for a crib, playpen or other height adjustable enclosure.

There is a growing awareness of the need to make juvenile furniture even safer for children. In the specific case of height-adjustable cribs and pens, considerable attention is being paid to making the crib less subject to being collapsed accidentally.

Some prior crib leg locks comprise a spring loaded pin mounted on a strap connected to the crib corner post and arranged to engage in openings in the extensible leg. When the pin is retracted the leg is free to move. These spring loaded locks are disadvantageous because they can be released by the child in the crib. Other cribs avoid this problem by securing the extensible leg to the corner post by passing a bolt through the corner post and leg and turning down a wingnut or threaded knob on the bolt to prevent the two from moving.

In some cases, the bolt opening through the extensible leg is an elongated slot so that it is only necessary to loosen the nut in order to move the leg. In other instances, the bolt has to be completely removed in order to reposition the leg. These prior constructions are not entirely satisfactory because in the former instance the crib is subject to accidental collapse if the nut should loosen, while in the latter case it takes a considerable amount of time and trouble to readjust the height of the crib.

SUMMARY OF THE INVENTION

Accordingly, the invention aims to provide a leg lock for a height-adjustable crib or playpen which cannot release accidentally, yet which can easily be released intentionally by the parent when it is desired to change the height of the crib.

Another object of the invention is to provide a leg lock of this general type which is relatively inexpensive to make.

Still another object of the invention is to provide a crib leg lock which will pass current government safety regulations on juvenile furniture.

A further object of the invention is to provide a crib leg lock which is less prone to accidental release by the child in the crib.

A further object of the invention is to provide a crib leg lock which is latched securely when it locks the leg at a selected height.

Other objects will in part be obvious and will in part appear hereinafter.

The invention accordingly comprises the features of construction, combination of elements and arrangment of parts which will be exemplified in the following detailed description, and the scope of the invention will be indicated in the claims.

Briefly, the subject leg lock is installed on each of the four corner posts of a conventional crib. It comprises a generally C-shaped stamped metal strap which is pivotally connected to opposite sides of the corner post and engages around the usual extensible leg slidably connected to that corner post. The strap is provided with a relatively sharp nose which projects into one of the usual positioning holes in the leg when the strap is swung against the leg so that the leg is locked at a selected lengthwise position relative to the corner post.

When the bracket is thus swung against the leg, a latch drops into a slot formed in the upper edge of the bracket so that the bracket itself is locked in that position. Thus, even though the crib is lifted from the floor so that there is no upward force on the corner supports, the bracket remains locked with its nose in the positioning hole in the leg.

When it is desired to release the lock, two separate and distinct manual procedures must be followed. First, the latch key must be lifted up out of the slot in the bracket. At the same time the bracket must be swung away from the leg, thereby withdrawing its nose from the positioning hole in the leg. The leg can then be moved to a new height after which the bracket can be repositioned against the leg with its nose in another hole therein. Whereupon the latch will again drop in the slot in the bracket thereby locking the bracket in place.

The chances of the average child being able to manipulate both the latch and the bracket so as to release the leg are quite small. Thus there is little likelihood of accidental collapse of the crib. Since the bracket and latch are simple stamped metal parts, the cost of incorporating the subject lock into a crib of otherwise conventional construction is relatively small.

DESCRIPTION OF THE PREFERRED EMBODIMENT

Figure 1:
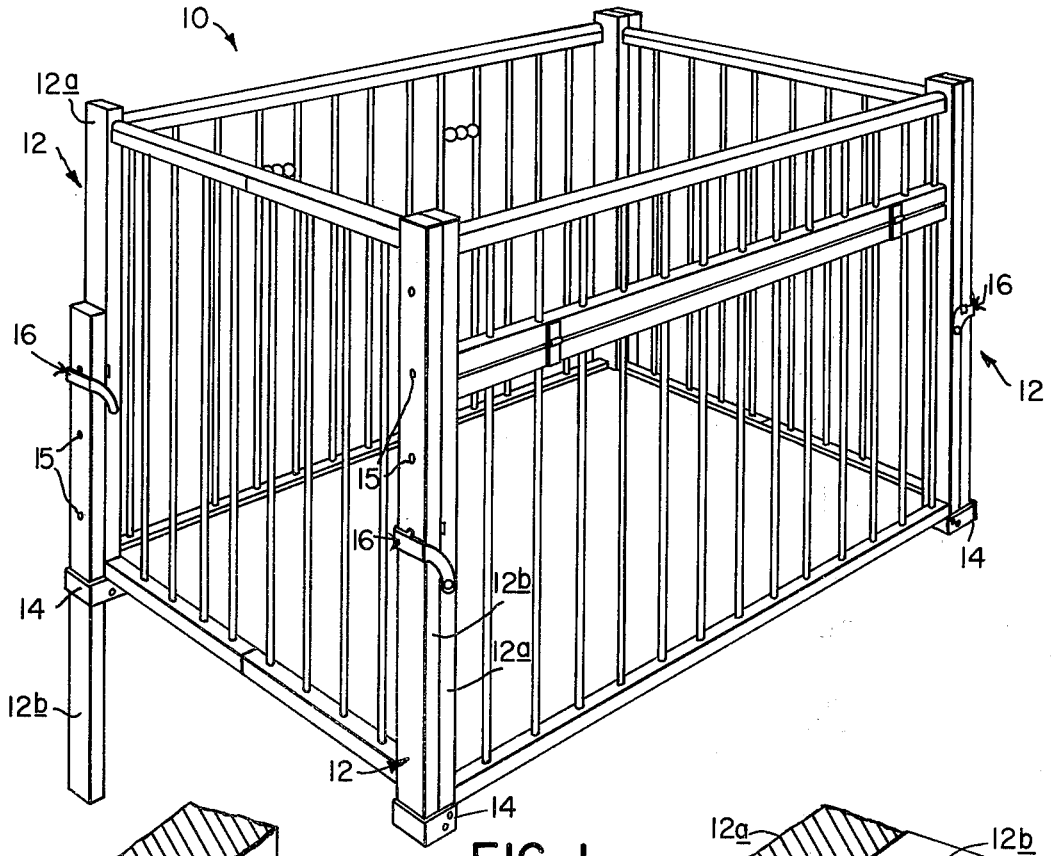
FIG. 1 is a perspective view of a crib including the improved crib leg lock.

Referring to FIG. 1 of the drawing, a crib shown generally at 10 has the usual corner supports indicated generally at 12. Since all these supports are identical, we will describe only one in detail. Each such support comprises a corner post 12*a* of the crib, and an extensible leg 12*b*. Leg 12*b* is slidably connected to the corner post by the usual C-shaped metal strap 14, which engages around leg 12*b* and whose ends are connected to opposite sides of the corner post by wood screws 13 (FIG. 2).

The leg 12*b* has the usual series of spaced openings 15, which cooperate with the subject leg lock shown generally at 16 to allow one to position crib 10 at a number of different elevations above the floor. Thus when the lock 16 is engaged in the uppermost hole 15, the leg 12*b* can extend down a considerable distance below the bottom of the crib. On the other hand, engagement of the lock 16 in the lowermost hole 15 positions the leg 12*b* so that its lower end is flush with the floor of the crib, thus enabling the crib to rest directly on the floor. Intermediate height adjustments of the crib are accomplished by engaging the lock 16 in the intermediate holes 15.

Figure 2:
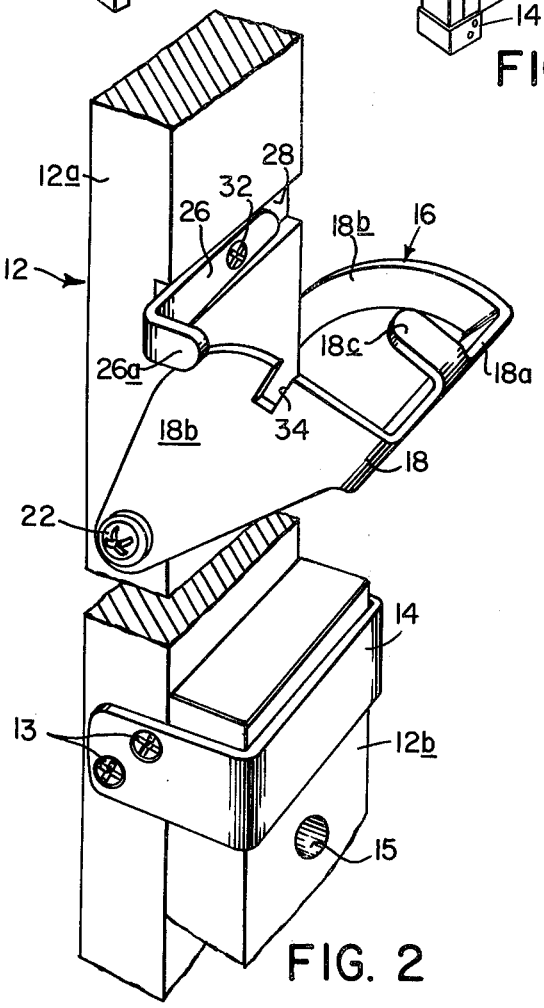
FIG. 2 is a fragmentary enlarged view of the crib leg lock in an unlocked position.
Figure 3:
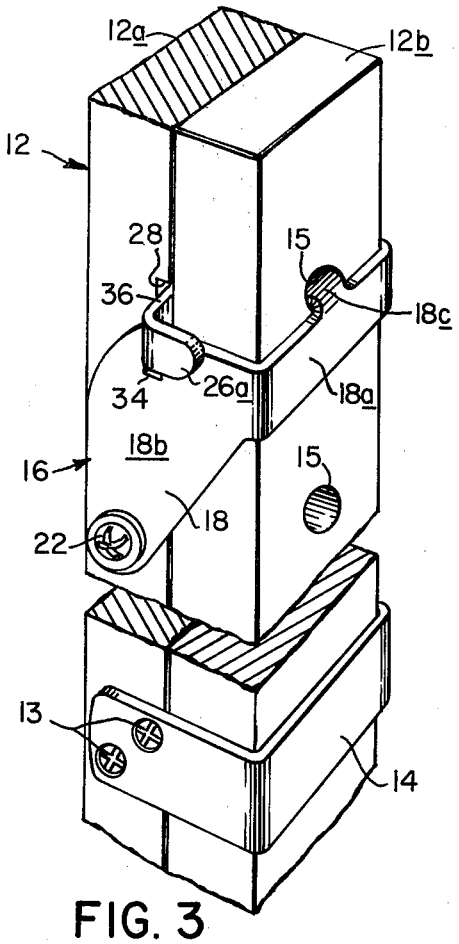
FIG. 3 is a fragmentary enlarged view of the crib leg lock in a locked position.

Referring now to FIGS. 2 and 3, lock 16 comprises a bracket 18 having a flat front face 18*a*, a pair of sides 18*b* extending at right angles to face 18*a* and considerably below that face. The bracket is arranged to engage around leg 12*b* and the lower edges of the bracket sides 18*b* are pivotally connected to corner post 12*a* by wood screws 22. These extend through suitable openings in the bracket sides and are turned down into opposite sides of the corner post, with the bracket being positioned almost midway up on the corner post.

The bracket 18 is formed with a relatively sharp nose 18*c* at the top of the front face 18*a*, which projects at right angles from that face toward leg 12*b*. Nose 18*c* is slightly narrower than the openings 15 in leg 12*b*, so that when the bracket 18 is swung upwardly with its front face 12*a* flush against leg 12*b*, the nose 18*c* can project into one of the openings 15, assuming of course that the leg 12*b* is at one of its selected positions of adjustment.

Lock 16 also includes an elongated L-shaped latch 26, which is recessed into a horizontal slot 28 in the outer face of corner post 12*a* just above bracket 18. The latch is pivotally connected to the corner post by a wood screw 32 extending through a suitable opening in the latch and turned down into the corner post. The latch extends beyond corner post 12*a* and terminates in a short leg 26*a*, bent at a right angle relative to the rest of the latch. The width of the slot 28 is somewhat greater than the width of the latch 26 so that the latch is free to pivot to a degree about screw 32. Further, the screw 32 is positioned toward the straight end of the latch so that the force of gravity causes the latch to swing downward about its pivot so that its end adjacent leg 26*a* rests against the lower wall of slot 28.

Latch 26 is arranged to engage in a slot 34 formed in the top edge of bracket side 18*b*, adjacent latch leg 26*a*, when nose 18*c* engages in one of the openings 15. As soon as the bracket is swung against the leg 12*b*, the latch drops into the slot 34, thereby locking the bracket in place, thus providing a double lock for the corner support 12. Also the upward force exerted on leg 12*b* tends to maintain the bracket 18 against the leg.

In order to change the height adjustment of each support, 12, it is necessary to lift latch 26 out of slot 34, using the latch leg 12*a* for this purpose. Then while the latch is raised, the bracket 18 must be swung away from leg 12*b*, thereby retracting nose 18*c* from opening 15. At this point the leg 12*b* can be slid up or down relative to its corner post and the lock repositioned in one of the other openings 15, whereupon the bracket will again be locked in place by latch 26.

It is apparent then that two distinctly different manual operations must be performed in order to release each support 12. Accordingly, the chances are minimal of a corner support being released accidentally as the crib is being moved by a child in the crib. Further, since the present lock is made of simple stamped metal parts, its cost is minimal.

It will thus be seen that the objects set forth above, among those made apparent from the preceding description, are efficiently attained and since certain changes may be made in the above construction without departing from the scope of the invention, it is intended that all matter contained in the above description or shown in the accompanying drawing shall be interpreted as illustrative and not a limiting sense.

It is also to be understood that the following claims are intended to cover all of the generic and specific features of the invention herein described.

I claim:

1. In combination with a height adjustable crib or the like of the type having a corner post and an extensible leg slidably connected to the corner post and having a series of holes along its length, a lock comprising A. a rigid bracket extending around the extensible leg and having sides lying flush against opposite sides of the corner post;

B. means for pivotally connecting the bracket sides to the corner post so that the bracket can be swung toward and away from the leg;

C. a rigid nose projecting from the bracket and extending toward the leg, said nose being arranged to engage in one of the leg holes when the bracket is swung against the leg so as to lock the leg at a selected position of lengthwise adjustment relative to the corner post, and D. means mounted on the corner post and cooperating with the bracket for removably retaining the bracket with its nose in said hole said retaining means comprising 1. a latch pivotally connected to the corner post adjacent to the bracket, and a slot formed in a side of the bracket, the sides of the slot being engaged by the latch when the bracket is positioned with its nose in said hole.

2. The lock defined in claim 1 wherein the bracket comprises a single rigid metal stamping.

3. The lock defined in claim 1 wherein the pivotal connection of the latch to the corner post is off center so that the force of gravity tends to maintain the latch in the slot when the bracket is positioned with its nose in said hole.

* * * * *